United States Patent [19]

Williams

[11] Patent Number: 4,776,126

[45] Date of Patent: Oct. 11, 1988

[54] TELESCOPE MOUNT FOR A FIREARM

[76] Inventor: Paul D. Williams, P.O. Box 155, Davison, Mich. 48423

[21] Appl. No.: 83,366

[22] Filed: Aug. 10, 1987

[51] Int. Cl.[4] ..... F41G 1/38

[52] U.S. Cl. ..... 42/101; 33/245; 33/247

[58] Field of Search ..... 42/101, 102, 103; 33/245–250

[56] References Cited

U.S. PATENT DOCUMENTS

| | | | |
|---|---|---|---|
| 1,009,282 | 11/1911 | Cobb | 33/246 |
| 2,396,404 | 3/1946 | Williams et al. | 42/101 |
| 2,777,202 | 1/1957 | Conte | 33/245 |
| 3,292,264 | 12/1966 | Kincannon | 33/245 |
| 3,406,455 | 10/1968 | Akin, Jr. | 33/245 |
| 3,671,000 | 6/1972 | Williams | 42/101 |
| 4,328,624 | 5/1982 | Ross | 33/245 |
| 4,383,371 | 5/1983 | Coffey | 33/245 |

FOREIGN PATENT DOCUMENTS

| | | | |
|---|---|---|---|
| 2419495 | 10/1979 | France | 42/102 |

OTHER PUBLICATIONS

"Weaver See-Thru Mounts", The American Rifleman, Jun. 1977, p. 45.

B-Square Co. Promotional Literature on "New Mount for the Ruger Blackhawk".

Weaver Catalog 1982, two sheets, on "New Scopes, New Mounts, New Spotting Scopes".

Three sheets of Photocopies of Williams' Gun Sights.

B-Square Co. Catalog No. 29 on "Scope Mounts" p. 5.

*Primary Examiner*—Deborah L. Kyle

*Assistant Examiner*—Michael J. Carone

*Attorney, Agent, or Firm*—Harness, Dickey & Pierce

[57] ABSTRACT

A telescope mount includes a generally planar support plate having at a forward end portion thereof an axial slot, a bracket to grip the barrel of a firearm and constrained by the slot for axial movement between selected locations along the barrel, means for releasably securing the bracket to the plate, and a fastening arrangement for securing the rearward end of the plate to the firearm. A cradle for receiving a scope is removably mounted to the support plate and could be removable therewith or by itself.

19 Claims, 1 Drawing Sheet

TELESCOPE MOUNT FOR A FIREARM

This invention relates to a telescope mount for a firearm and in particular to a mount for a handgun affording two points of securement one which is axially moveable and/or which is replaceable to accommodate barrels having different cross-sections, lengths and diameters.

Telescope mounts for firearms (i.e., rifles and handguns) are known and typically comprise a support which is secured to the barrel or receiver of the firearm and a cradle formed by a pair of halr-ring elements which are detachably connected together to clamp about the scope. A potential problem for a mount is lack of rigidity when mounted, scope interchangeability, and adjustability to different but similar guns.

To maintain positional accuracy of the scope relative to the firearm, axially spaced supports may be required. Due to its length the rifle provides more locations for positioning a support. The handgun, however, is short and offers less opportunity for mounting the scope to the firearm at locations which will be simple to attach to yet be sufficiently rigid to resist recoil forces from the larger caliber pieces, such as that of a 0.44 magnum. Desirably the supports should be rigidly secured in their desired spacing yet also be adjustable axially along the handgun and/or releasable for mounting on firearms having different barrel sizes, lengths and diameters. Drilling and tapping into the handgun while oftentimes necessary should be held at a minimum.

In accord with this invention a telescope mount for a handgun comprises a single support plate being securable to the top of the barrel and bridging the firing chamber opening. A securing arrangement includes threaded fasteners which rigidly secure a rearward end portion of the plate to the body of the handgun and releasably secure a forward end portion of the plate to a bracket sized to releasably clamp about the gun barrel. In the forward securement, the threaded fastener extends through a laterally narrowed slot in the plate to attach to the bracket. The head of the fastener seats on a ledge of the slot with threaded rotation in one direction advancing the head towards the bracket and each into gripping relation against the plate thereby preventing axial movement of the bracket/fastener from that location and contrariwise if rotation is in the other direction. A scope retaining cradle secured to the support plate may be removed to mount differently configured scopes or "opened" to replace a scope.

Advantageously the scope mount of the present invention is securable at its rearward end to existing tapped holes in the handgun for securement thereto but yet is adjustable at its forward end to accept different brackets which clamp to firearms having different barrel lengths, diameters and cross-sections. Further the cradle may be easily replaced or allow replacement of like scopes.

Other advantages of the present invention will become apparent from the following detailed description taken into conjunction with the accompanying drawings in which.

Figure 1:
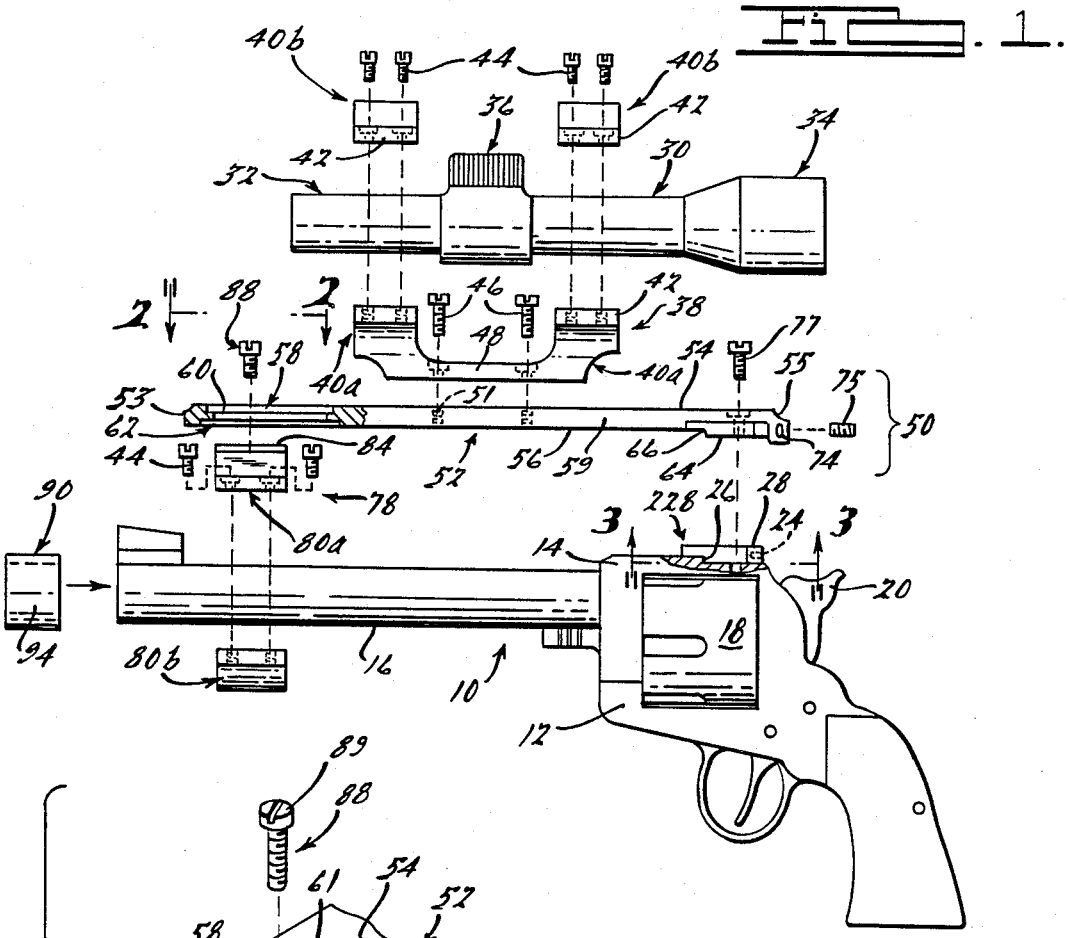
FIG. 1 is an exploded assembly view of a telescope mount of the present invention partially in section and shown in operative association with a handgun.

Turning now to the drawings, FIG. 1 shows an assembly 100 of a handgun 10 for receiving a telescope mount 50. The handgun is of the type including a main body 12, a firing chamber 18 rotatably supported in an opening in the body, an elongated tubular barrel 16 extending from the body, and a firing hammer 20. A support portion or frame 14 above the firing chamber includes a pair of upwardly extending ribs 22 (see FIG. 3), the ribs being longitudinally extending, laterally spaced and configured to fit within detents 70*a*, 70*b* formed in the mount whereby to provide a rearward retention nest for the mount.

The mount 50 includes a removable cradle 38 to releasably receive a scope 30 and a support plate 52. As shown, the scope includes a tubular portion 32, an enlarged sighting lens portion 34, and a central adjustment portion 36. The scope could be any commercially available scope depending on the needs of the user.

The support plate 52 is generally planar and includes top and bottom surfaces 54,56, longitudinally extending sides 57,59 and forward and rearward ends 53,55. The forward end portion includes an axial opening extending between its surfaces to describe an axial slot 58 in the top surface, an axial slot 62 in the bottom surface, and a narrowed axial slot 61 interconnecting the slots and sized to receive a threaded portion of fastener 88. The slot 58 defines a ledge 60 for the head 89 of the fastener to engage when the threaded portion is inserted through the slot 61. When the plate is mounted to the handgun the axial slot 61 is generally coplanar to and positioned above the axis of the barrel.

A bracket 78 is configured for seating in slot 62, the bracket having top and bottom portions 80*a*,80*b* adapted to be secured together and clamp about the forward end portion of the barrel, the top portion 80*a* being threadably connected to the fastener 88. A C-shaped sleeve 90 comprised of flexible polymer is interposed between the outer periphery of the barrel and the inner walls of the brackets when needed to accommodate different barrel diameters.

The rearward end portion of support plate 52 includes a threaded hole 76 extending between the top and bottom surfaces, a pair of threaded holes 74 extending longitudinally into the end 55, and an axially extending shoulder 64 extending perpendicularly from its bottom surface. While shown best in FIG. 3, the shoulder defines a pair of detents 70*a*,70*b* each extending laterally inward from one respective side 57,59, the shoulder being adapted to insertably nest between the ribs 22 whereby the shaped portions of the detents fit about the shaped portions of the ribs. A threaded fastener 77 passes through hole 76 to threadably enage a corresponding threaded socket 15 extending vertically downwardly into support portion 14. A threaded fastener 75 threadably passes through each respective hole 74 in the plate to engage a respective threaded hole 24 extending longitudinally into the support portion 14.

The cradle 38 includes a body portion 48 and forward and rearward bracket portions 40*a*,40*b*, each bracket portion including a lip 42 to receive a threaded fastener 44 to join the bracket portions together and clampingly engage the scope. When joined the inner walls of the bracket portions form a generally continuous cylindrical surface for clamping securely about the scope. A pair of threaded fasteners 46 extend through body portion 48 whereby to engage threaded sockets 51 of support plate 52. The rearward terminus of axial slot 61 is forward of bracket portion 40*a*.

Figure 2:
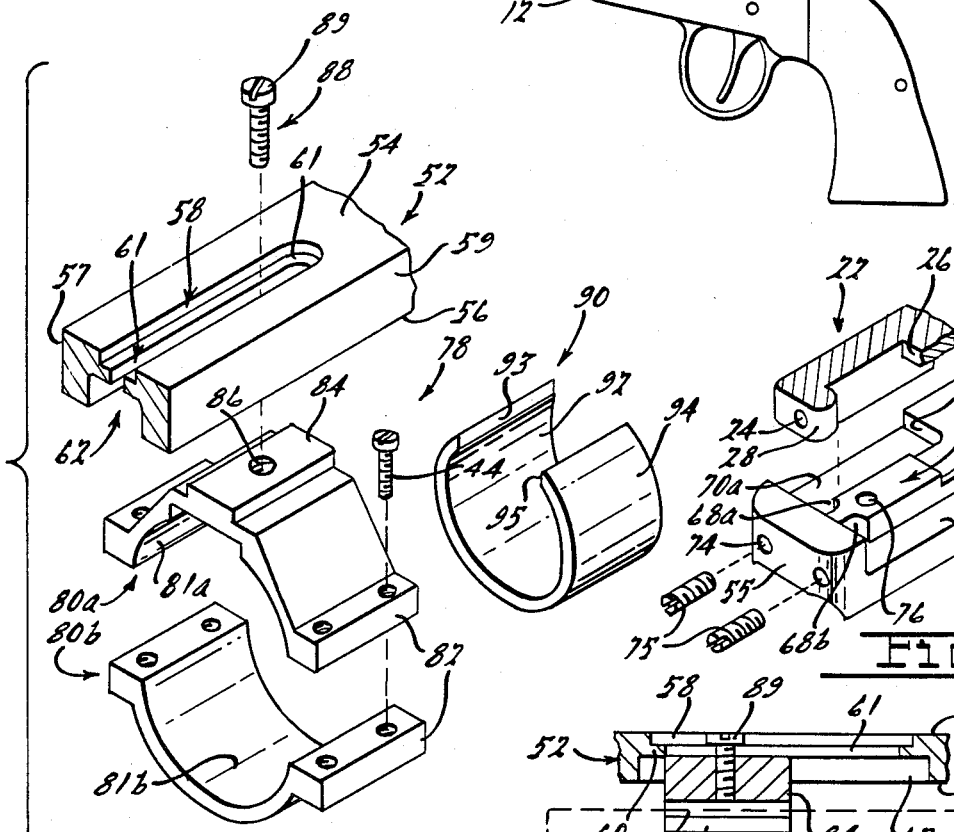
FIG. 2 is a fragmentary perspective view partially in section taken along lines 2—2 of FIG. 1 looking down on the forward end portion of the mount positioned for assembly to the barrel of the handgun.

FIG. 2 shows the forward end portion of the mount 50 with the support plate 52 being partially cut away to show the axial slot 61 for receiving the threaded portion of fastener 88, the ledge 60 for receiving the head 89, the upper and lower axial slots 58,62, and the bracket 78 positioned to be received in the lower slot. The bracket 78 includes a rectangularly configured head 84 the lateral sidewalls of which being adapted to clearance fit between the lateral sidewalls of the lower axial slot 62 whereby to constrain the bracket 78 for axial movement therewithin. The threaded fastener 88 is tightened or loosened from its engagement within socket 86 whereby if tightened to draw the bracket 78 and head 89 grippingly against the support whereby to prevent axial movement of the top portion 89a and contrariwise if the fastener is loosened. Advantageously top portion 80*a* prevents the bracket 78 from rotating such that the bracket is always positioned relative to the barrel. The top and bottom portions 80*a*,80*b* have generally semi-cylindrical walls 81*a*,81*b* and an outer lip 82, the brackets being fastened together by a suitable fastener such as shown by fasteners 44 passing through the lips. The adapter 90 is semi-cylindrical, preferably of a resilient plastic both for the purposes of yielding between the bracket portions 80*a*,80*b* and protecting the outer periphery of the barrel.

Figure 3:
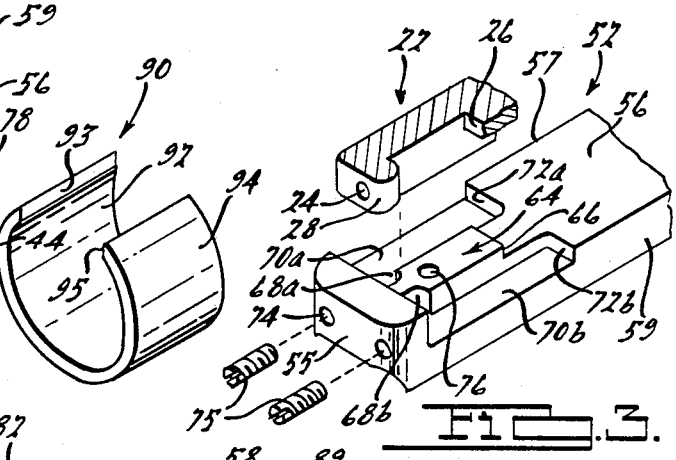
FIG. 3 is a fragmentary view taken through the handgun along lines 3—3 of FIG. 1 and looking up at the rearward end portion of the mount.

FIG. 3 shows the rearward end portion of the support plate 52 positioned for insertion onto the gun. While only one rib 22 is shown, each rib 22 includes the shaped head 28 with the respective heads facing towards one another, a rearward facing abutment 26, and the threaded socket 24. The ribs are longitudinally extending and laterally spaced to receive the shoulder 64 therebetween, the forward faces of the ribs 28 and the screws 75 cooperating to prevent axial movement of the support plate relative to the gun body.

The support plate 52 includes with shoulder 64 a pair of laterally spaced longitudinally extending detents 70*a*,70*b* each extending laterally inward from one respective edge 57,59 and vertically coextensive with shoulder 64. Each detent includes a shaped portion 68*a*,68*b* to receive the respective heads 28 on the ribs 22 and a rearward facing abutment 72*a*,72*b* each to abut the forward end of one respective rib. The shoulder 64 is stepped and includes a forwardly facing abutment 66 to engage the rearward facing abutment 26 on the support portion 14 of the handgun 10 whereby to prevent forward axial movement. The threaded holes 74 each for receiving a threaded fastener 75 are positioned with the threaded socket 24 in one respective rib 22. The threaded hole 76 vertically through the support plate 52 passes threaded fastener 77 to engage the threaded socket 15 in the handgun.

Figure 4:
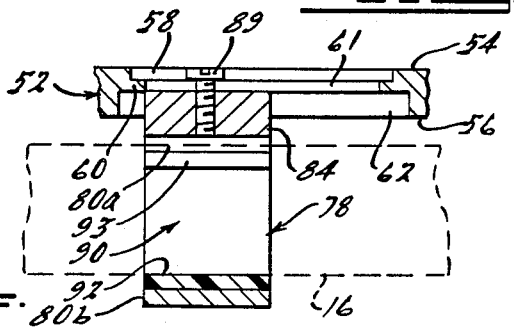
FIG. 4 is a section view showing the forward end portion of the mount assembled to the barrel of the handgun.

FIG. 4 shows the bracket 78 in support plate 52 secured to the forward end portion of the barrel 16. The rearward end 55 of the support plate (not shown) is rigidly secured into support portion 14 of the handgun by the longitudinally and vertically extending fasteners 75,77.

To adjust the location of bracket 78 relative to the barrel 16, the fastener 88 is loosened thereby allowing head 84 of the bracket to move axially relative to the barrel and within the limits of slot 62. Of course the bracket portions 80*a*, 80*b*, if clamped about the barrel, would also be loosened by means of fasteners 44 partially releasing their grip on lips 82. Once the bracket 28 has been moved axially, the fasteners are retightened.

To adjust for barrels of different lengths and diameters, the cylindrical sleeve 90 could be changed (or eliminated). The adjust for telescopes of different lengths, the fastener 88 is loosened whereby the top bracket portion 80*a* may axially slide within the slot 62.

What is claimed is:

1. In combination, a generally planar support plate having a forward and rearward end portion adapted to be connected to a firearm having a tubular barrel, a cradle mounted to the support plate for retaining a telescope, and securing means for securing the support plate to the firearm and preventing movement of the support plate relative to said barrel, said securing means being characterized by the support plate having an axial slot in the forward end portion thereof, a bracket partially disposed in said slot for releasably gripping the barrel, first fastener means partially disposed in said slot and threadably fastened to said bracket for rigidly fastening the bracket to said plate and/or releasing its fastening thereby permitting the axial position of said bracket relative to the barrel to be selectively changed, and second fastening means to releasably fasten the rearward end portion to said firearm, said second fastening means comprising mating elements on said firearm and support plate, respectively, including one or more detents and one or more ribs each being like-shaped so that the rib will conformingly seat in the detent.

2. The invention as recited in claim 1 wherein said one or more ribs includes a pair of ribs extending upwardly from said firearm.

3. The invention as recited in claim 2 wherein said second fastening means includes a pair of threaded fasteners each extending from the support plate, one fastener to threadably engage said rib and the other fastener to threadably engage said firearm.

4. The invention as recited in claim 1 wherein said second fastening means includes a threaded fastener threadably connecting said support plate to said firearm.

5. The invention as recited in claim 1 wherein said cradle is one-piece and is disposed between the end portions of the support plate.

6. The invention as recited in claim 1 wherein the bracket has an upper and a lower portion each being removably joinable to form a continuous surface to grip about the barrel.

7. The invention as recited in claim 6 wherein said first fastener means comprises a threaded fastener member including a threaded shaft engageable with the upper portion of said bracket and a head captivated for axial movement within the slot to constrain the bracket for axial movement relative thereto.

8. The invention as recited in claim 6 wherein said support plate has a bottom and a top surface facing, respectively, toward and away from said firearm, and said slot extends between said surfaces.

9. The invention as recited in claim 8 wherein the bottom surface includes an axial slot having a lateral width substantially the same as a lateral width defining the upper portion of said bracket, said axial slot receiving and constraining the orientation of said bracket relative to said barrel.

10. A mount for securing a telescope sight to a handgun having a tubular barrel, said mount comprising;

a support plate having a forward and rearward end portion and adapted to be rigidly secured to said handgun, said forward end portion including an axial slot positionable along the axis of said barrel when said support plate is secured to the handgun, releasable clamping means defining an opening therein for clamping around the barrel, securing means disposed in said slot for releasably securing said clamping means relative to the barrel whereby to allow the axial location of said clamping means to be selectively changed, and, first fastening means extending transversely to and second fastening means in the direction of said axis for fastening the rearward end portion of said support plate to the handgun.

11. The invention as recited in claim 10, including cradle means extending from the support plate for releasably retaining the telescope sight, said cradle means including a depending bracket portion for grippingly receiving the telescope sight.

12. The invention as recited in claim 10 wherein said opening is defined by upper and lower braclet portions each bracket portion defining partial opposed sidewall portions, the bracket portions being securely joinable whereby the sidewall portions grip the outer periphery of the barrel.

13. The invention as recited in claim 12 wherein said upper bracket portion is axially adjustable within said slot, and the rearward terminus of said slot is axially forward of said cradle means.

14. A mount for mounting a telescopic sight comprising;

a support plate having a top and a bottom surface and adapted to be rigidly secured to the top of a firearm such that the bottom surface confronts the firearm, said plate having a first and second bracket each said bracket having, respectively, a first and second tubular opening extending in a plane parallel to the axis of the firearm, said first bracket and its opening extending above the top surface to receive said sight and said second bracket and its opening being slidably attached to said support plate and disposed below the bottom surface for gripping about the firearm, a fastener having a first and second portion connected, respectively, to said second bracket and said support plate such that by adjusting the fastener the second bracket can be brought tightly against the plate and be firmly secured to the firearm at selected axial locations, the first and second portions of said fastener comprise a head and a threaded shaft, said support plate includes an axial slot extending between its top and bottom surfaces to receive said shaft whereby to constrain the bracket for axial movement within said slot, and fastening means rearwardly of the first tubular opening for nonadjustably fixing one end of said support plate to the firearm.

15. The invention as recited in claim 14 wherein an axial slot extends along and inwardly of said top surface to define an axial ledge to receive the head portion, threadedly advancing said threaded shaft in one direction securing the second bracket relative to the support plate but in the other direction releasing and allowing the second bracket to move axially relative to the firearm.

16. In combination, a generally planar support plate having a forward and rearward end portion adapted to be connected to a firearm having a tubular barrel, a cradle mounted to the support plate for retaining a telescope, and securing means for securing the support plate to the firearm and preventing movement of the support plate relative to said barrel, said securing means being characterized by the support plate having an axial slot in the forward end portion thereof, a bracket partially disposed in said slot for releasably gripping the barrel, said bracket including an upper and lower portion each being removable and joinable to form a continuous surface to grip about the barrel, first fastener means partially disposed in said slot and threadably fastened to said bracket for rigidly fastening the bracket to said plate and/or releasing its fastening thereby permitting the axial position of said bracket relative to the barrel to be selectively changed, and second fastening means to releasably fasten the rearward end portion to said firearm.

17. The invention as recited in claim 16 wherein said first fastener means comprises a threaded fastener member including a threaded shaft engageable with the upper portion of said bracket and a head captivated for axial movement within the slot to constrain the bracket for axial movement relative thereto.

18. The invention as recited in claim 16 wherein said support plate has a bottom and a top surface facing, respectively, toward and away from said firearm, and said slot extends between said surfaces.

19. The invention as recited in claim 18 wherein the bottom surface includes an axial slot having a lateral width substantially the same as a lateral width defining the upper portion of said bracket, said axial slot receiving and constraining the orientation of said bracket relative to said barrel.

* * * * *